United States Patent [19]

Palazzolo

[11] Patent Number: 4,846,396

[45] Date of Patent: Jul. 11, 1989

[54] CONTAINER MADE OF FOLDED PLANAR MATERIAL HAVING PRECREASED GRIPPING AREA AND BLANK FOR SAME AND METHOD OF MANUFACTURE

[76] Inventor: Frank Palazzolo, 60 E. 96th St., New York, N.Y. 10128

[21] Appl. No.: 202,136

[22] Filed: Jun. 3, 1988

[51] Int. Cl.[4] ..... B65D 5/46

[52] U.S. Cl. ..... 229/52 B; 222/210; 222/465.1; 229/125.42; 493/160; 493/909

[58] Field of Search ..... 229/52 B, 1.5 B, 125.42; 206/621.1, 621.2, 621.3, 621.6, 631.1, 631.3; 222/210, 465.1, 528, 572; 493/160, 161, 909

[56] References Cited

U.S. PATENT DOCUMENTS

| | | | |
|---|---|---|---|
| 1,872,771 | 8/1932 | Little | 222/572 |
| 2,013,243 | 9/1935 | Landon | 222/465.1 |
| 3,369,727 | 2/1968 | Wright | 206/631.2 |
| 3,390,827 | 7/1968 | Malby et al. | 229/52 B |
| 3,390,828 | 7/1968 | Malby et al. | 229/52 B |
| 3,628,719 | 12/1971 | Ford, Sr. | 229/52 B |
| 3,924,797 | 12/1975 | Furbeck | 206/631.3 |
| 4,327,861 | 5/1982 | Thompson | 229/52 B |

FOREIGN PATENT DOCUMENTS

| | | | |
|---|---|---|---|
| 3222017 | 12/1983 | Fed. Rep. of Germany | 229/125.42 |
| 986657 | 3/1965 | United Kingdom | 229/52 B |

*Primary Examiner*—Gary Elkins

*Attorney, Agent, or Firm*—Kenyon & Kenyon

[57] ABSTRACT

A container and blank for a container comprising folded planar material wherein the planar material is provided with fold lines during manufacture, the planar material adapted to be folded along the fold lines so as to form the container, the container when so folded having a plurality of sides, a top and a bottom, selected portions of the planar material comprising tabs adapted for fastening the planar material together to form the container after folding, the planar material further comprising preferably at least two crease lines formed in a selected portion of the planar material forming a side of the container, the crease lines each delimiting an area for facilitating gripping by a user, the areas each having a maximum width, the crease lines allowing the container formed of the planar material to constrict in width adjacent the areas by substantially the sum of the maximum widths of the areas, thereby facilitating gripping by the user.

36 Claims, 1 Drawing Sheet

CONTAINER MADE OF FOLDED PLANAR MATERIAL HAVING PRECREASED GRIPPING AREA AND BLANK FOR SAME AND METHOD OF MANUFACTURE

BACKGROUND OF THE INVENTION

The present invention relates to the field of containers, and in particular, to a container made of folded planar material, for example, paper, cardboard, waxed cardboard, plastic laminated cardboard or paper, or plastic, and adapted to hold contents ranging from liquids to solid materials, such as granular material or particulates. In particular, the present invention relates to a container made from folded planar material, which has formed therein during manufacture creased areas for facilitating gripping of the container by a user. For example, the present invention may be particularly useful in facilitating the gripping of rather bulky containers such as one-half gallon milk containers, breakfast cereal boxes and laundry detergent boxes.

Various arrangements for facilitating the gripping of containers by users are known. For example, see U.S. Pat. Nos. 3,628,719, 3,952,940, 4,327,861 and 4,415,082. All of these designs are either unconventional or expensive, difficult to manufacture or require specialized machinery in order to manufacture the containers. Also see U.S. Pat. Nos. 3,815,809, 4,214,697, 4,243,171, 3,570,744, 3,581,974, 4,134,534 and 4,411,383 which show various handles or carrying means for containers.

SUMMARY OF THE INVENTION

It is an object of the present invention to provide a container made of folded planar material and which is adapted to hold various contents ranging from fluids to solids and which is provided with areas for facilitating gripping by a user.

It is furthermore an object of the present invention to provide a container made of conventional planar materials, such as paper, plastic laminated cardboard, waxed cardboard or plastic, and which is adapted to hold various contents such as liquids or particulates, and which is provided with precreased areas during manufacture for facilitating gripping by a user.

It is yet still another object of the present invention to provide such a container with precreased gripping areas which can be formed into the container easily during manufacture by conventional equipment.

It is yet still a further object of the present invention to provide such a container having precreased gripping areas which can be manufactured inexpensively.

The above and other objects of the present invention are achieved by a container comprising folded planar material wherein the planar material is provided with fold lines during manufacture, the planar material adapted to be folded along the fold lines so as to form the container, the container when so folded having a plurality of sides, a top and a bottom, selected portions of the planar material comprising tabs adapted for fastening the planar material together to form the container after folding, the planar material further comprising at least one crease line formed in a selected portion of the planar material forming a side of the container, said crease line delimiting an area for facilitating gripping by a user, said area having a maximum width, said crease line allowing the container formed of the planar material to constrict in width adjacent the area by substantially the maximum width of the area, thereby facilitating gripping by the user.

Preferably, the crease line has an arcuate shape extending substantially in the vertical direction of the container.

Preferably, two such crease lines are provided on opposite edges of a side of the container, allowing the container to constrict by substantially the sum of the maximum widths of the two areas.

BRIEF DESCRIPTION OF THE DRAWINGS

The invention will be described in greater detail in the following detailed description with reference to the drawings, in which.

DETAILED DESCRIPTION

Figure 3:
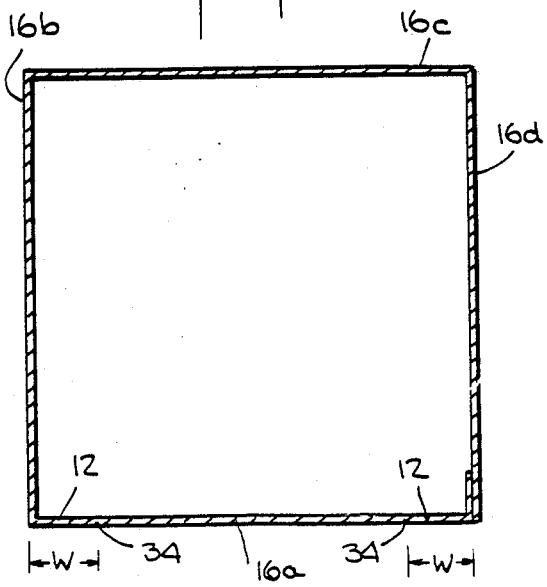
FIG. 3 is a cross-sectional view of the container shown in FIG. 1 along the lines 3—3 of FIG. 1.
Figure 4:
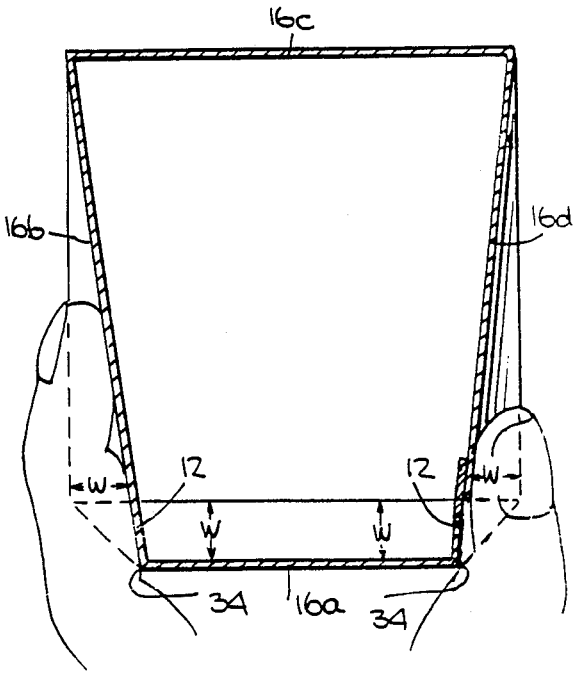
FIG. 4 is a cross-sectional view of the container of FIG. 1 taken along lines 3—3 of FIG. 1 with the container being handled by a user showing the constriction of the container.
Figure 5:
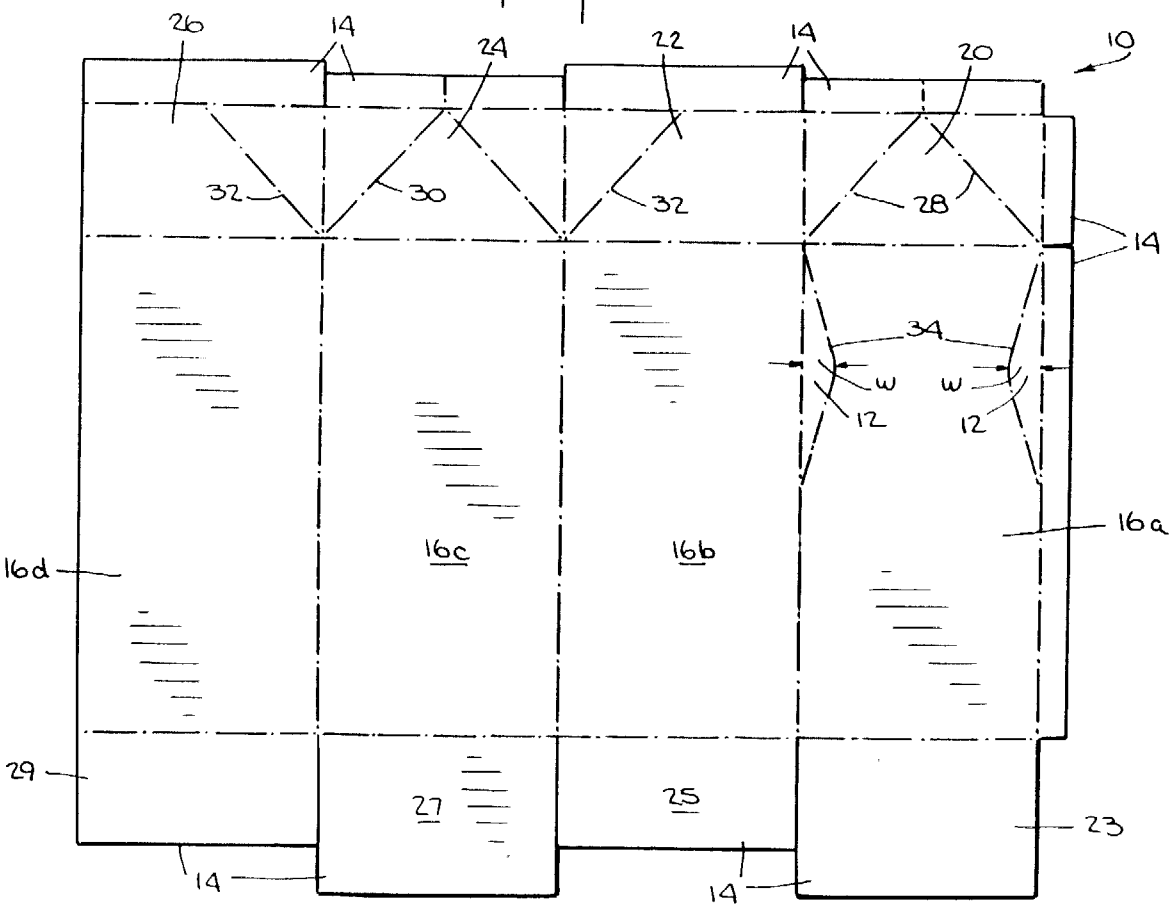
FIG. 5 is laid out view of the container shown in FIG. 1 prior to its assembly showing the precreased gripping areas formed into the planar material comprising the container.

With reference now to the drawings, FIGS. 1 to 5 show one embodiment of a container 10 according to the present invention having precreased gripping areas 12 formed in the planar material comprising the container. FIG. 5 is a laid out view of the container 10 prior to its assembly by conventional methods, for example, gluing along a plurality of tabs 14. The container shown in FIGS. 1 to 5 includes four sides **16*a*, 16*b*, 16*c* and 16*d*, and is of the type commonly known in the trade as the "gable" design because it is provided with a peaked top 18. The container top portion is formed from four sections 20, 22, 24 and 26. These sections are formed with creased fold lines 28, 30 and 32, as shown, with fold lines 30 and 32 being adapted for forming a spout 31 in the container as well known. The bottom is formed from four sections 23, 25, 27 and 29**.

The container shown in FIGS. 1 through 5 is provided with additional creased lines 34 in one side **16*a* thereof. In particular, in the embodiment shown in FIGS. 1 to 5, the creased lines 34 are formed in the side 16*a* of the container opposite the side 16*c* to which the top portion 24 is attached having the pouring spout 31 creased lines 30 formed therein. These creased lines 34 preferably have an arcuate shape as shown, thus providing a griphold when the container is grasped by a user. Preferably, the creased lines begin at an edge 13 of the container, proceed toward the center of the side, reaching a maximum width W (measured horizontally) and then proceed back toward the edge 13**.

Figure 1:
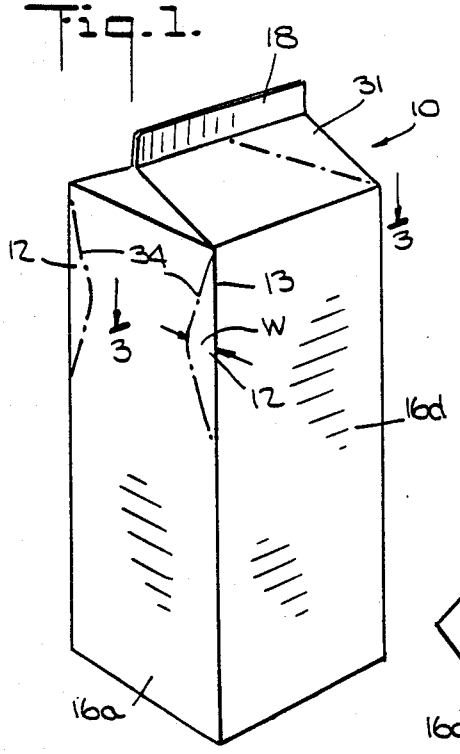
FIG. 1 shows a perspective view of one embodiment of the container according to the present invention.
Figure 2:
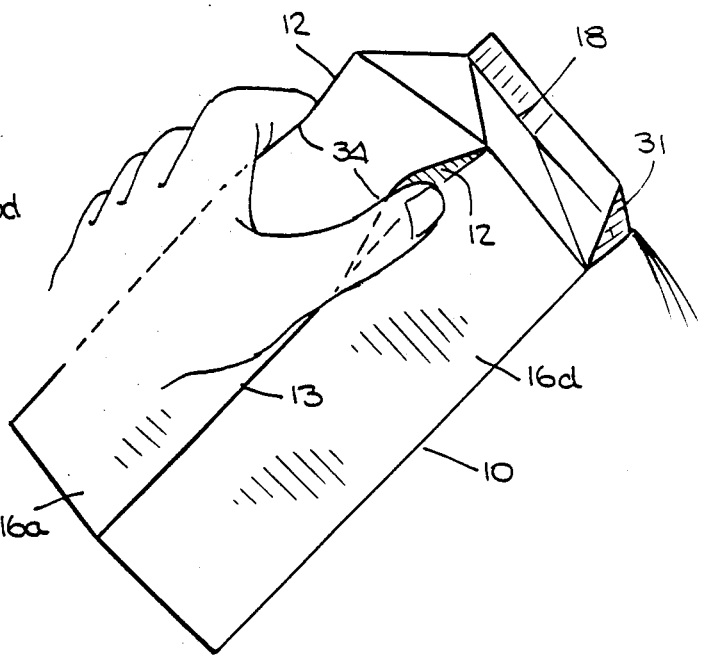
FIG. 2 shows the container of the present invention holding a liquid and in use.

As shown in FIG. 2, the container is grasped by two of the sides **16*b* and 16*d* near the precreased gripping areas 12. Because of the creased lines 34 delineating these gripping areas 12, the container, which may be approximately rectangular in cross-section when not in use, as shown in FIG. 3, constricts adjacent the areas 12, forming a grip hold in the container due to the constriction in the width of the container at these areas. A cross-sectional view along the lines 3—3 of FIG. 1 showing the container in use is shown in FIG. 4. As shown, the creases 34 allow the container to flex along these crease lines, thus reducing the width of the container at the cross-sectional lines 3—3 by substantially twice the maximum width of the areas 12 (if the areas 12 have the same maximum width W). The maximum width W of the areas 12 is shown in FIGS. 3, 4 and 5. At the same time that the width (horizontally in FIGS. 3 and 4) of the container is reduced, the depth (vertically in FIG. 4) of the container along the lines 3—3 in cross-section is approximately increased by the amount W. This is shown in FIG. 4**.

Figure 6:
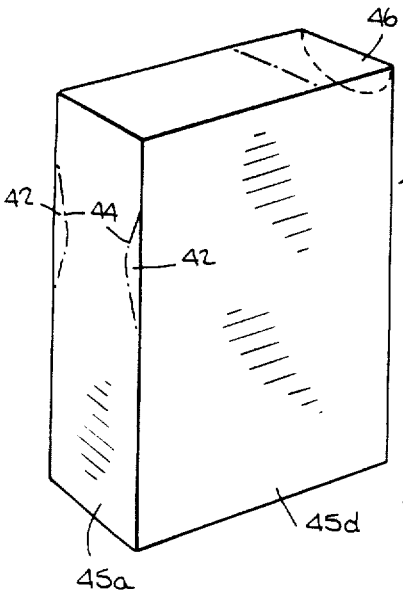
FIG. 6 is a perspective view of another embodiment of a container according to the present invention adapted for dispensing particulate material, for example, a breakfast cereal or laundry detergent.
Figure 7:
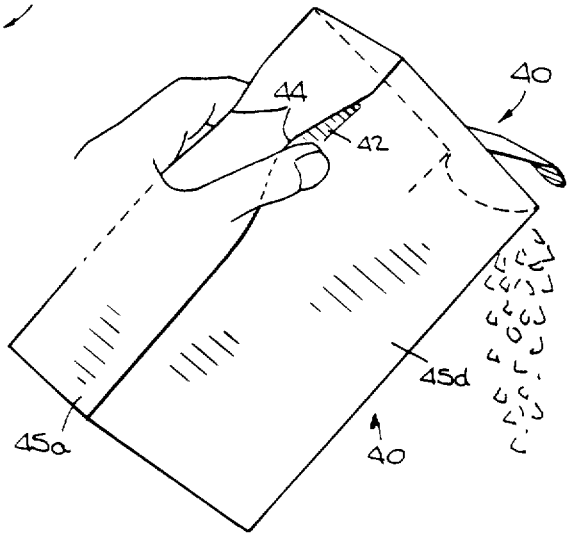
FIG. 7 shows the embodiment of FIG. 6 in use.
Figure 8:
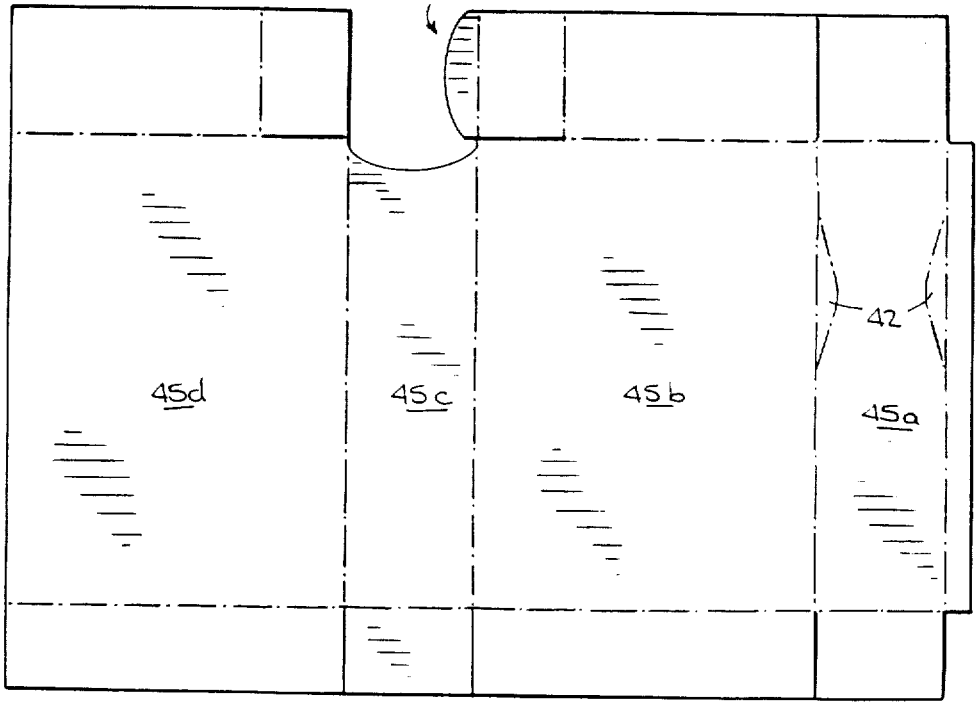
FIG. 8 shows a laid out view of the container shown in FIG. 6 prior to assembly.

FIGS. 6, 7 and 8 show a further embodiment of the container according to the present invention. This container 40 is adapted for the pouring of particulate material such as laundry detergent or breakfast cereal. Again, this container is formed with precreased gripping areas 42 delineated by fold lines 44 formed in a side 45*a* thereof. This container 40 may be formed with a conventional break-away pouring spout 46 which is initially opened by the user.

FIG. 7 shows the container of FIG. 6 in use and FIG. 8 is a laid out view of the container prior to assembly by conventional means such as gluing techniques.

In the foregoing specification, the invention has been described with reference to specific exemplary embodiments thereof. It will, however, be evident that various modifications and changes may be made thereunto without departing from the broader spirit and scope of the invention as set forth in the appended claims. For example, only one creased line 34, 44 need be provided, but two opposed creased lines preferably are provided, as described. Also, the planar material may comprise various materials, such as paper, cardboard or plastic. The specification and drawings are, accordingly, to be regarded in an illustrative rather than in a restrictive sense.

What is claimed is:

1. A container comprising folded planar material wherein the planar material is provided with fold lines during manufacture, the planar material being folded along the fold lines so as to form the container, the container having a plurality of sides, a top and a bottom, selected sections of the planar material comprising tabs fastening the planar material together to form the container, the planar material further comprising at least one crease line formed in a selected portion of the planar material forming at least one of the sides of the container, said crease line delimiting an area for facilitating gripping by a user, said side of the container having the selected portion being substantially flat except when pressure is applied to said area by the user, said area having a maximum width, said crease line allowing the container to constrict in width adjacent the area by substantially the maximum width of the areas, thereby facilitating gripping by the user.

2. The container recited in claim 1, wherein said crease line is formed in an arcuate shape extending substantially vertically.

3. The container recited in claim 2, wherein the crease line begins at an edge of the side of the container having the selected portion, proceeds toward the center of the side of the container so as to reach the maximum width in a horizontal direction of the container and then proceeds again toward the edge of the side of the container.

4. The container recited in claim 1 having at least two crease lines formed in the selected portion of the planar material forming said at least one side of the container, the crease lines each delimiting an area for facilitating gripping by a user, said areas each having a maximum width, said crease lines allowing the container formed of the planar material to constrict in width adjacent the areas by substantially the sum of the maximum widths of the areas, thereby facilitating gripping by the user.

5. The container recited in claim 1 adapted for the pouring of liquids and having a gable top.

6. The container recited in claim 1, wherein the top portion has a spout adapted for the dispensing of particulate material.

7. The container recited in claim 1, wherein the planar material comprises cardboard.

8. The container recited in claim 1, wherein the planar material comprises plastic laminated cardboard.

9. The container recited in claim 1, wherein the planar mateiral comprises plastic.

10. A method for manufacturing a container made of folded planar material comprising providing the planar material with fold lines, the planar material being folded along the fold lines so as to form the container, the container having a plurality of sides, a top and a bottom, selected sections of the planar material comprising tabs fastening the planar material together to form the container, and further comprising providing the planar material with at least one crease line formed in a selected portion of the planar material forming at least one of the sides of the container, said crease line delimiting an area for facilitating gripping by a user and allowing said side of the container having the selected portion to be substantially flat except when pressure is applied to said area by the user, said area having a maximum width, said crease line allowing the container formed of the planar material to constrict in width adjacent the area by substantially the maximum width of the area, thereby facilitating gripping by the user.

11. The method for manufacturing a container recited in claim 10 wherein the step of providing a crease line comprises providing an arcuate crease line substantially extending vertically.

12. The method for manufacturing a container recited in claim 11, wherein the step of providing a crease line comprises providing said crease line so that the crease line begins at an edge of the side of the container having the selected portion, proceeds toward the center of the side of the container so as to reach the maximum width in a horizontal direction of the container and then proceeds again toward the edge of the side of the container.

13. The method for manufacturing a container recited in claim 10 comprising providing at least two crease lines in the selected portion of the planar material forming said at least one side of the container, the crease lines each delimiting an area for facilitating gripping by a user, said areas each having a maximum width, said crease lines allowing the container formed of the planar material to constrict in width adjacent the areas by substantially the sum of the maximum widths of the areas, thereby facilitating gripping by the user.

14. The method for manufacturing a container recited in claim 10, wherein the container is adapted for the pouring of liquids and further comprising forming a gable top on said container.

15. The method for manufacturing a container recited in claim 10, further comprising forming a spout on the top portion of the container and wherein the container is adapted for the dispensing of particulate material.

16. The method for manufacturing a container recited in claim 10, wherein the planar material comprises cardboard.

17. The method for manufacturing a container recited in claim 10, wherein the planar material comprises plastic laminated cardboard.

18. The method for manufacturing a container recited in claim 10, wherein the planar material comprises plastic.

19. A blank for a container comprising foldable planar material wherein the planar material is provided with fold lines during manufacture, the planar material adapted to be folded along the fold lines so as to form the container, the container when so folded having a plurality of sides, a top and a bottom, selected sections of the planar material comprising tabs adapted for fastening the planar material together to form the container after folding, the planar material further comprising at least one crease line formed in a selected portion of the planar material forming at least one of the sides of the formed container, said crease line delimiting an area for facilitating gripping by the user, said side having the selected portion when formed into the container being substantially flat except when pressure is applied to said area of the formed container by the user, said area having a maximum width, said crease line allowing the container formed of the planar material to constrict in width adjacent the area by substantially the maximum width of the area, thereby facilitating gripping by the user.

20. The blank for a container recited in claim 19, wherein said crease line is formed in an arcuate shape extending substantially vertically.

21. The blank for a container recited in claim 20, wherein the crease line begins at an edge of the side of the formed container having the selected portion, proceeds toward the center of the side of the formed container so as to reach the maximum width in a horizontal direction of the formed container and then proceeds again toward the edge of the side of the formed container.

22. The blank for a container recited in claim 19 having at least two crease lines formed in the selected portion of the planar material forming said at least one side of the formed container, the crease lines each delimiting an area for facilitating gripping by a user, said areas each having a maximum width, said crease lines allowing the formed container to constrict in width adjacent the areas by substantially the sum of the maximum widths of the areas, thereby facilitating gripping by the user.

23. The blank for a container recited in claim 19 adapted for forming a container for the pouring of liquids and having a gable top.

24. The blank for a container recited in claim 17, wherein the top portion of the formed container has a spout adapted for the dispensing of particulate material.

25. The blank for a container recited in claim 19, wherein the planar material comprises cardboard.

26. The blank for a container recited in claim 19, wherein the planar material comprises plastic laminated cardboard.

27. The blank for a container recited in claim 19, wherein the planar material comprises plastic.

28. The method for manufacturing a blank for a container made of foldable planar material comprising providing the planar material with fold lines, the planar material adapted to be folded along the fold lines so as to form the container, the container when so folded having a plurality of sides, a top and a bottom, selected sections of the planar material comprising tabs adapted for fastening the planar material together to form the container after folding, and further comprising providing the planar material with at least one crease line formed in a selected portion of the planar material forming at lesat one of the sides of the container, said crease line delimiting an area for facilitating gripping by a user and allowing said side of the container formed from the planar material having the selected portion to be substantially flat except when pressure is applied to said area of the formed container by the user, said area having a maximum width, said crease line allowing the container formed of the planar material to constrict in width adjacent the area by substantially the maximum width of the areas, thereby facilitating gripping by the user.

29. The method for manufacturing a blank for a container recited in claim 28 wherein the step of providing a crease line comprises providing an arcuate crease line substantially extending vertically.

30. The method for manufacturing a blank for a container recited in claim 29, wherein the step of providing a crease line comprises providing said crease line so that the crease line begins at an edge of the side of the formed container having the selected portion, proceeds toward the center of the side of the formed container so as to reach the maximum width in a horizontal direction of the formed container and then proceeds again toward the edge of the side of the formed container.

31. The method for manufacturing a blank for a container recited in claim 28 comprising providing at least two crease lines in the selected portion of the planar material forming said at least one side of the formed container, the crease lines each delimiting an area for facilitating gripping by a user, said areas each having a maximum width, said crease lines allowing the container formed of the planar material to constrict in width adjacent the areas by substantially the sum of the maximum widths of the areas, thereby facilitating gripping by the user.

32. The method for manufacturing a blank for a container recited in claim 28, wherein the formed container is adapted for the pouring of liquids and further comprising forming a gable top on said container.

33. The method for manufacturing a blank for a container recited in claim 28, further comprising forming a spout on the top portion of the container formed from the blank and wherein the container formed from the blank is adapted for the dispensing of particulate material.

34. The method for manufacturing a blank for a container recited in claim 28, wherein the planar material comprises cardboard.

35. The method for manufacturing a blank for a container recited in claim 28, wherein the planar material comprises plastic laminated cardboard.

36. The method for manufacturing a blank for a container recited in claim 28, wherein the planar material comprises plastic.

* * * * *

UNITED STATES PATENT AND TRADEMARK OFFICE

CERTIFICATE OF CORRECTION

PATENT NO. : 4,846,396

DATED : July 11, 1989

INVENTOR(S) : FRANK PALAZZOLO

It is certified that error appears in the above-identified patent and that said Letters Patent is hereby corrected as shown below:

Title page, third line of title, change "AREA" to --AREAS--.

Title page, under the abstract, change "1 Drawing Sheet" to --3 Drawing Sheets--.

The attached additional two drawing sheets including FIGS. 5 through 8 should be inserted as per attached sheets.

Col. 1, line 4, change "AREA" to --AREAS--.

Col. 2, line 25, after "is" and before "laid" insert --a--.

Col. 6, line 3, change "The" to --A--.

Col. 6, line 14, change "lesat" to --least--.

Col. 6, line 23, change "areas" to --area--.

Signed and Sealed this

Tenth Day of July, 1990

*Attest:*

HARRY F. MANBECK, JR.

*Attesting Officer*

*Commissioner of Patents and Trademarks*